US006085932A

United States Patent [19]

Cope

[11] Patent Number: 6,085,932

[45] Date of Patent: Jul. 11, 2000

[54] CONTAINERS

[76] Inventor: Andrew Christopher Cope, 3 Sheldon Avenue, Wednesbury, West Midlands, United Kingdom

[21] Appl. No.: 09/283,031

[22] Filed: Apr. 1, 1999

Related U.S. Application Data

[63] Continuation of application No. 08/821,907, Mar. 21, 1997.

[30] Foreign Application Priority Data

Mar. 22, 1996 [GB] United Kingdom ..... 9606090

[51] Int. Cl.[7] ..... B65D 25/06

[52] U.S. Cl. ..... 220/529; 220/533; 220/534

[58] Field of Search ..... 220/529, 532, 220/533, 534, 535, 536, 539; 206/505, 506, 514

[56] References Cited

U.S. PATENT DOCUMENTS

| | | | |
|---|---|---|---|
| Re. 22,234 | 12/1942 | West | 220/547 |
| 835,670 | 11/1906 | Falvey | 220/547 |
| 865,706 | 9/1907 | Hutchins et al. | 220/546 |
| 1,874,367 | 8/1932 | Seyl | 220/547 |
| 3,262,559 | 7/1966 | Geiger | 206/772 |
| 3,391,816 | 7/1968 | Swett | 220/354 |
| 3,540,786 | 11/1970 | Potter | 220/532 |
| 3,659,743 | 5/1972 | Box | 206/506 |
| 4,261,464 | 4/1981 | Maitland . | |
| 4,372,444 | 2/1983 | Le Grand et al. . | |
| 4,479,684 | 10/1984 | Doyel | 220/345 |
| 4,502,609 | 3/1985 | Christatos | 220/345 |
| 4,610,358 | 9/1986 | Walter | 206/514 |
| 4,763,782 | 8/1988 | Sinchok . | |
| 4,809,851 | 3/1989 | Oestreich, Jr. et al. | 220/4.31 |
| 4,838,445 | 6/1989 | Lanius . | |
| 4,947,992 | 8/1990 | Schafer | 206/506 |
| 4,974,898 | 12/1990 | Baranski | 220/345 |
| 5,261,736 | 11/1993 | Sisbarro | 220/345 |
| 5,395,049 | 3/1995 | Huhn | 229/120.02 |
| 5,711,423 | 1/1998 | Fuller, Jr. | 220/546 |

FOREIGN PATENT DOCUMENTS

| | | | |
|---|---|---|---|
| 1 188 323 | 9/1959 | France | 206/506 |
| 1188323 | 9/1959 | France . | |
| 1385805 | 12/1965 | France . | |
| 446769 | 5/1936 | United Kingdom . | |
| 731049 | 6/1955 | United Kingdom . | |
| 1160414 | 8/1969 | United Kingdom . | |
| 1 378 353 | 12/1974 | United Kingdom | 206/506 |
| 2 228 921 | 9/1990 | United Kingdom . | |

*Primary Examiner*—Stephen Castellano
*Attorney, Agent, or Firm*—Adams Law Firm, P.A.

[57] ABSTRACT

A container having walls and defining a space between the walls in which articles may be contained. The container includes a partition and attachment. The attachment is operable, in use, to adjustably attach the partition to the container within the space, to form a smaller space of variable size. The attachment includes complementary formations on the container and on the partition, which mate so attach the partition to the container. There is sufficient resilience in or associated with the complementary formations to allow the partition to be adjusted along an adjustment direction by the application of sufficient force in that direction fo force the complementary formations tp disengage.

8 Claims, 7 Drawing Sheets

18
3
-22-
24
26
10
3
-12C-

30
31
31
29
32
30
12

10
28
24
26
22
12C

CONTAINERS

This application is a continuation of application Ser. No. 08/821,907, filed on Mar. 21, 1997.

The present invention relates to containers and particularly, but not exclusively, to containers for use in transporting goods to retail premises, and for displaying goods at retail premises.

It is convenient for the owners of retail premises if the containers in which goods are received can be used to display the goods to the purchaser, preferably by forming the delivery containers into a stack. For instance, when goods are transported in cardboard boxes, it is sometimes provided that part of one wall of the cardboard box can be torn away to display the goods within. This is not particularly attractive and moreover, cardboard boxes generally cannot be used more than once, particularly if they have been torn open. The cost of using fresh cardboard containers for every consignment can be considerable.

However, using re-usable containers, such as plastics containers can cause problems, particularly with fragile goods, if those goods do not fit tightly into the container. Any slight freedom of movement for fragile goods, such as eggs, can result in expensive breakages occurring during delivery.

According to the present invention, there is provided a container defining a space in which articles may be contained, and comprising partition means and attachment means, the attachment means being operable, in use, to adjustably attach the partition means to the container within the space, to form a smaller space of variable size.

The position of the partition means may be adjusted along an adjustment direction by the application of sufficient force in that direction to overcome the attachment means. The attachment means may comprise complementary formations on the container and on the partition means, which mate to attach the partition means to the container. There may be sufficient resilience in or associated with the complementary formations to allow the partition means to be adjusted by forcing the complementary formations to disengage. The complementary formations may comprise a first formation having a plurality of projections or recesses, and a second formation comprising at least one complementary projection or recess, wherein adjustment is effected by relative movement of the formations to receive the projection in another recess.

The first formation may comprise a plurality of parallel ribs forming the said projections and defining the said recesses therebetween. The second formation may comprise a rib for receipt in a recess of the first formation. The first formation is preferably fixed relative to the container, and the second formation is preferably fixed relative to the partition means. The ribs may extend vertically, in use, to allow adjustment in a horizontal direction.

The container may be open-topped and comprise four walls upstanding from a base to define the space, the partition means being attachable in a generally upright orientation and in the vicinity of one of the walls, to adjust the size of the space. The partition means may be accessible through a wall for adjustment from outside the container.

Preferably the container is a stacking/nesting container, the container and partition means being formed so that, when a container is introduced into a like container for nesting, the container and the partition means of the like container cooperate to move the partition means to a position at which nesting is possible.

In a second aspect, the invention provides a container having a wall upstanding from a base during normal use, the wall comprising at least one shutter element which is movable relative to the rest of the container between an open position in which contents of the container are exposed through an opening in the wall, and a closed position in which the opening is closed by the shutter element.

Preferably the shutter element is slidably mounted relative to the rest of the container. The shutter element may be slidable in a generally vertical direction. The opening left by the shutter element is preferably at or near the top of the container. There my be at least two shutter elements movable as aforesaid. The first shutter element may be movable alongside a second shutter element, and there after to move with the second shutter element. Preferably the second shutter element is retained in its closed position until the first shutter element has moved alongside it.

The wall may comprise a fixed wall portion and at least one shutter element movable to overlie the fixed portion. The wall may comprise a fixed wall portion and two shutter elements located one above the other when the wall is fully closed. The vertical heights of the shutter elements and the wall portion are preferably approximately equal, whereby the wall may be fully closed or have approximately one third or two thirds of its height open.

Preferably the container is nestable with a second like container. The shutter elements are preferably so formed as to engage a second like container into which the container is being introduced for nesting, the engagement causing the elements to move to their closed positions as the containers are nested.

Preferably the container comprises a support member on which a like container may stack. The container preferably has an open top across which the support member extends when supporting a stacked container. The support member may be movable to a stowed position clear of the open top to allow nesting. The support member may hang down outside the wall of the container when stowed. The support member is preferably pivotally mounted at the tope of wall of the container.

The upper edge of the wall to which the support member is pivotted is preferably provided, at least in part, by a shutter element which may slide from an upper, closed position to a lower, open position. The support member may move down to a lower, stowed position when the shutter element moves to the lower, open position. The support member may be moved to the upper stowed position when the shutter element has moved to the upper, closed position.

Embodiments of the present invention will now be described in more detail, by way of example only, with reference to the accompanying drawings, in which.

Figure 1:
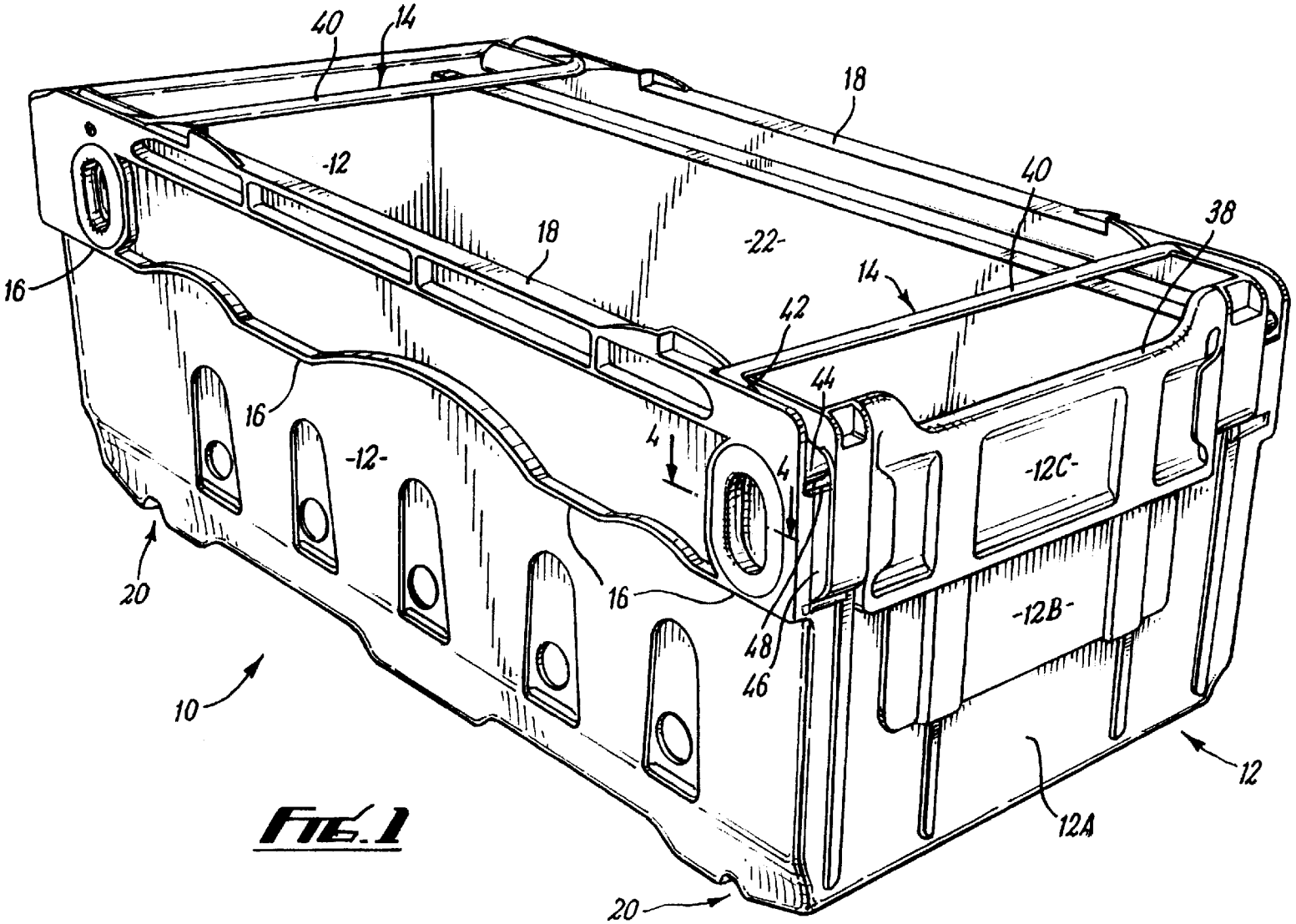
FIG. 1 is a schematic perspective view of a container according to the present invention.

The container 10 of FIG. 1 has an umber of features which are conventional in plastics containers for use in delivering goods to retail outlets. The container is generally parallelpipedal and open-topped, with four walls 12 upstanding from a base (not shown in FIG. 1). Stacking bars 14 allow like containers to be stacked but are pivotally mounted so they may be swung away. This leaves the open top of the container 10 unobstructed. The walls 12 slope slightly so that a like container can then be nested in a container below. When fully nested, the discontinuous surface 16 will rest on the upper surface 18 around the mouth of the container 10. When stacked, notches 20 in the base of the container sit over the bars 14. The walls 12 define within the container 10 a space in which articles may be contained. For instance eggs in cardboard egg boxes can be stacked in the container 10. However, the size of cardboard egg containers vary slightly, particularly for different egg sizes. Consequently, a box designed for one egg size and cardboard container might not be usable with other sizes which would either not fit or be too small, in the latter case being vulnerable to damage during transport.

Figures 2, 3, 4:
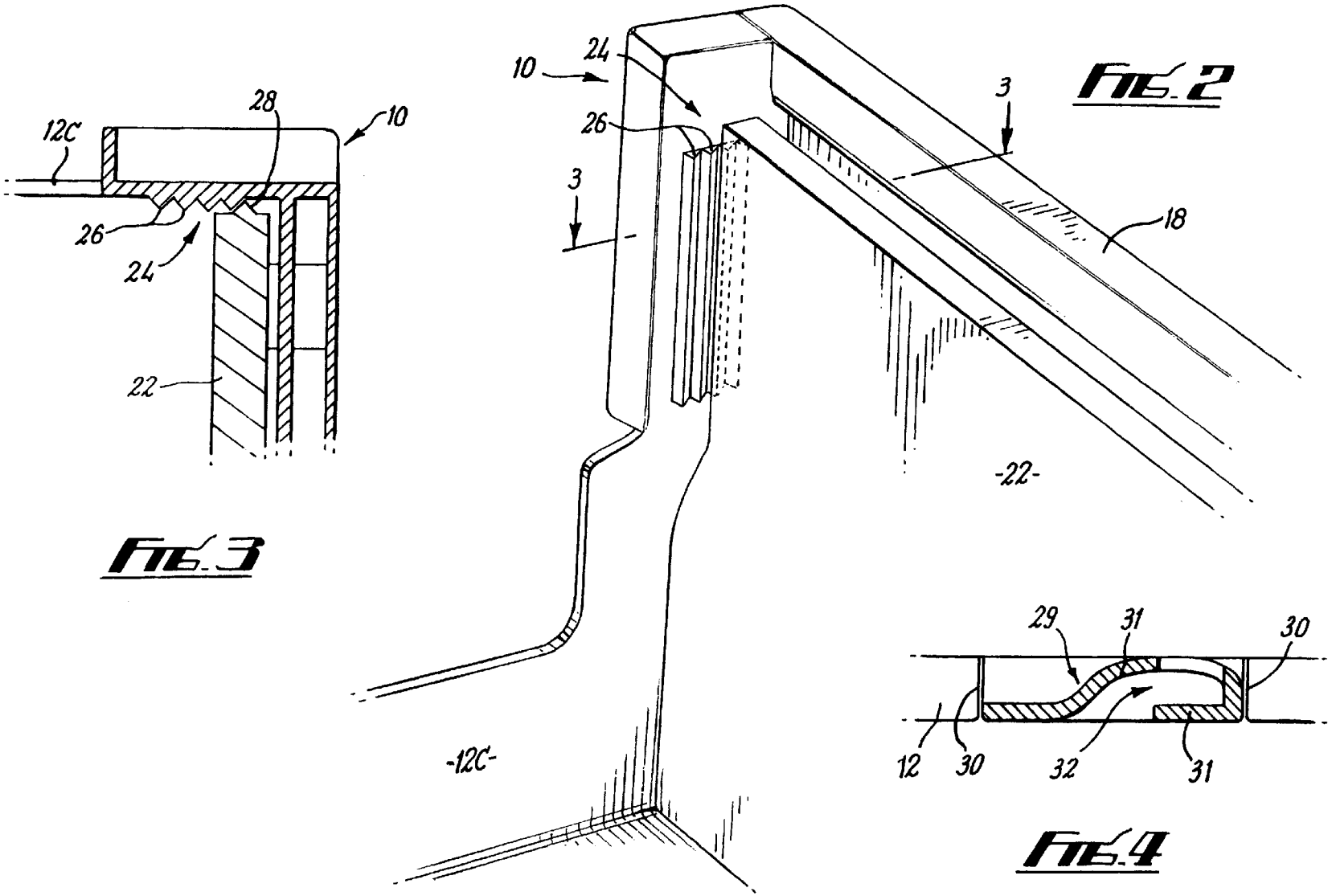
FIG. 2 is an enlarged, partial perspective view of the inside of the container of FIG. 1, at one corner with stacking bars omitted, for clarity.
FIG. 3 is a plan section at the line 3—3 of FIG. 2.
FIG. 4 is a section in plan along the line 4—4 in FIG. 1.

In order to deal with this problem, the container 10 incorporates additional features in accordance with the invention. A partition 22 runs the whole length of one of the longer walls of the container 10, just inside that wall. The partition 22 is attached at each end to the shorter walls of the container by attachment means in the region indicated at 24 (FIGS. 2 and 3). The attachment means (not shown in detail) may consist of one or more tabs projecting from the partition 22 through corresponding slots in the container walls, and having enlarged heads to retain the partition. The tabs may slide along the slots but are retained in them by the heads. A series of parallel, vertical ribs 26 on the container wall, and a single rib 28 on the end of the partition 22 are associated with the attachment at 24. The rib 28 and the ribs 26 are complementary in shape, so that the rib 28 may sit securely between a selected pair of the ribs 26 and thereby be prevented from horizontal movement perpendicular to the ribs 26, 28. The size of the container space available for containing goods will depend on the choice of ribs 26 between which the rib 28 is located.

In this example, all components of the container 10 are manufactured from a plastics material, preferably by injection moulding. Consequently, there will be resilience in the components. This allows the position of the partition 22 to be changed by forcing the rib 28 out of one groove between adjacent ribs 26, against the resilience of the structures, to click into a different groove. It is envisaged that the components can be designed so that the force required to adjust the partition position is greater than the forces likely to be experienced during normal use, so that the partition 22 will normally remain fixed in the chosen position until deliberately moved, for instance when the container is to be used for different articles. It will be apparent that the ribs 26, 28 could themselves be resilient, or there could be resilience associated with them, such as in the wall 12.

Consequently, if the container which has been used for goods of a particular size is to be re-used for goods of a slightly smaller size, the partition 22 can be clicked inwardly to slightly reduce the size of the container space, for thereby holding the smaller goods adequately securely. Conversely, if the container space is now required to be larger, the partition 22 can be clicked outwardly. In one preferred mode of operation, the container is always filled while the partition 22 is at its outermost position, with the container space at its largest. After filling, the partition 22 can then be pushed in to grip the contents, using the attachment 26, 28 as a form of ratchet and pawl mechanism to hold the partition 22 after the position has been set.

The container is designed to allow the partition positions to be adjusted by hand from outside the containers. At both ends of each partition 22, a button 29 is exposed through an aperture 30 in the wall 12. As can be seen from FIG. 4, the button 29 does not have a continuous outer surface, but two lips 31 between which there is a gap 32 allowing a finger to pull on the outer lip 31 to pull the partition out toward the wall 12. Conversely, a finger may press on the inner lip 31 to push the partition 22 further in (away from the wall 12).

Figure 5:
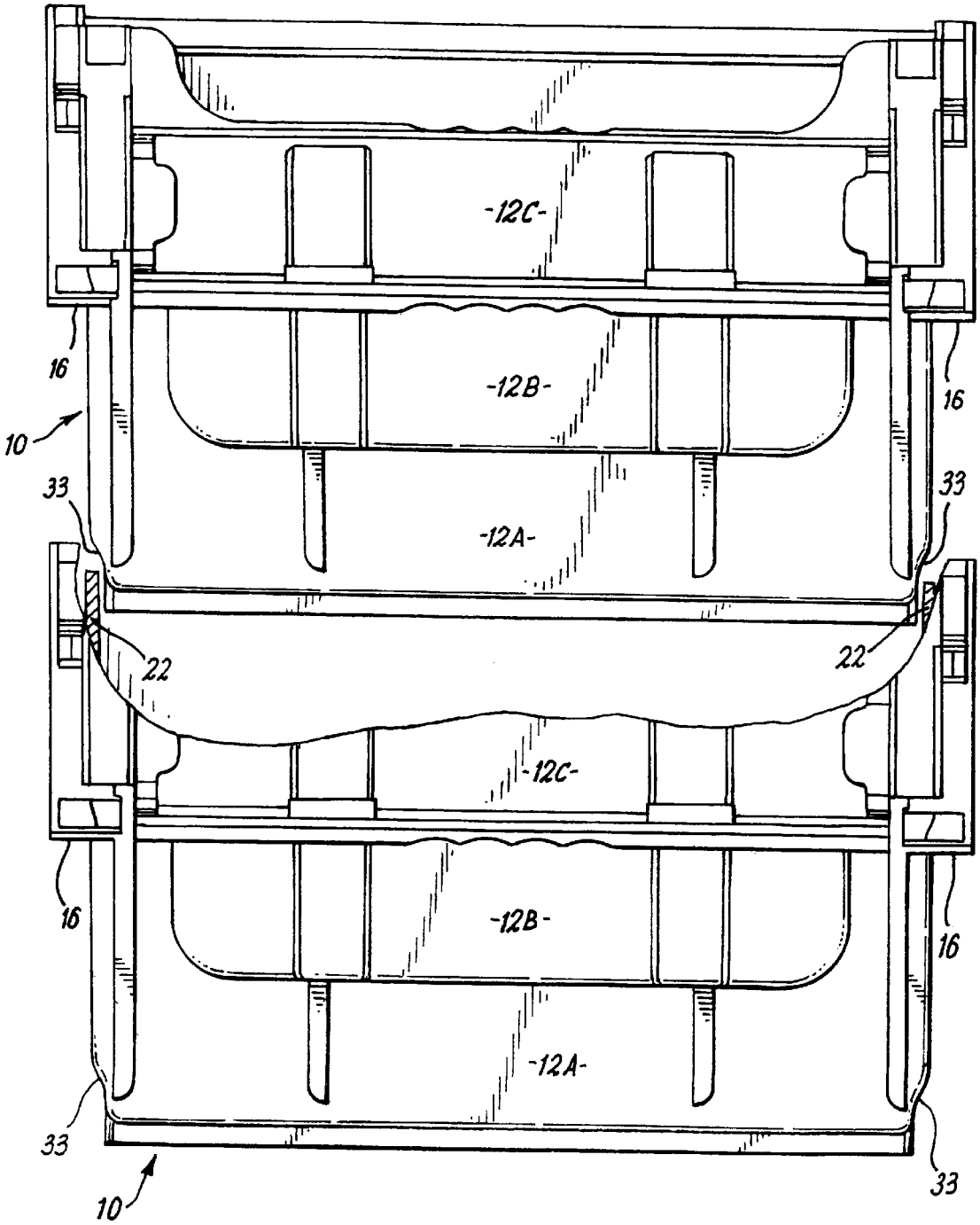
FIG. 5 is an end elevation showing two containers being nested.

This mode of operation is facilitated if the container walls are formed to engage the partition 22 of a lower container into which a container is being nested, and to force it to its outermost position as containers are nested. Containers are usually nested for return transport when empty. Thus, the containers would then always have the largest available space when being refilled, until the partition 22 was pushed in to accommodate the new contents. An arrangement of this nature is shown in FIG. 5. This shows an upper container being introduced into a lower container for nesting, with part of the lower container cut away for clarity.

It can be seen from FIG. 5 (more clearly than other figures) that the containers are slightly less wide close to their base, than higher up. This results in a lead-in surface running horizontally along the walls. The base can be inserted between the partitions 22 of a lower container, as shown in FIG. 5. As the upper container continues to move down, the lead-in surfaces 33 will bear on the partitions 22. The partitions will be forced apart as further downward pressure is applied to the upper container.

Figure 7:
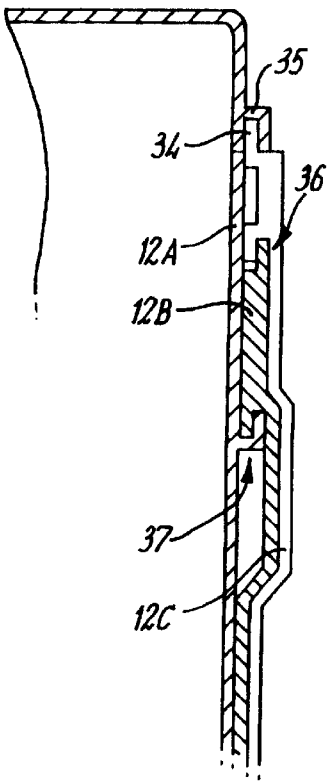
FIG. 7 is a horizontal section through the wall of FIG. 4, at the line 5—5 of FIG. 4.
Figure 6:
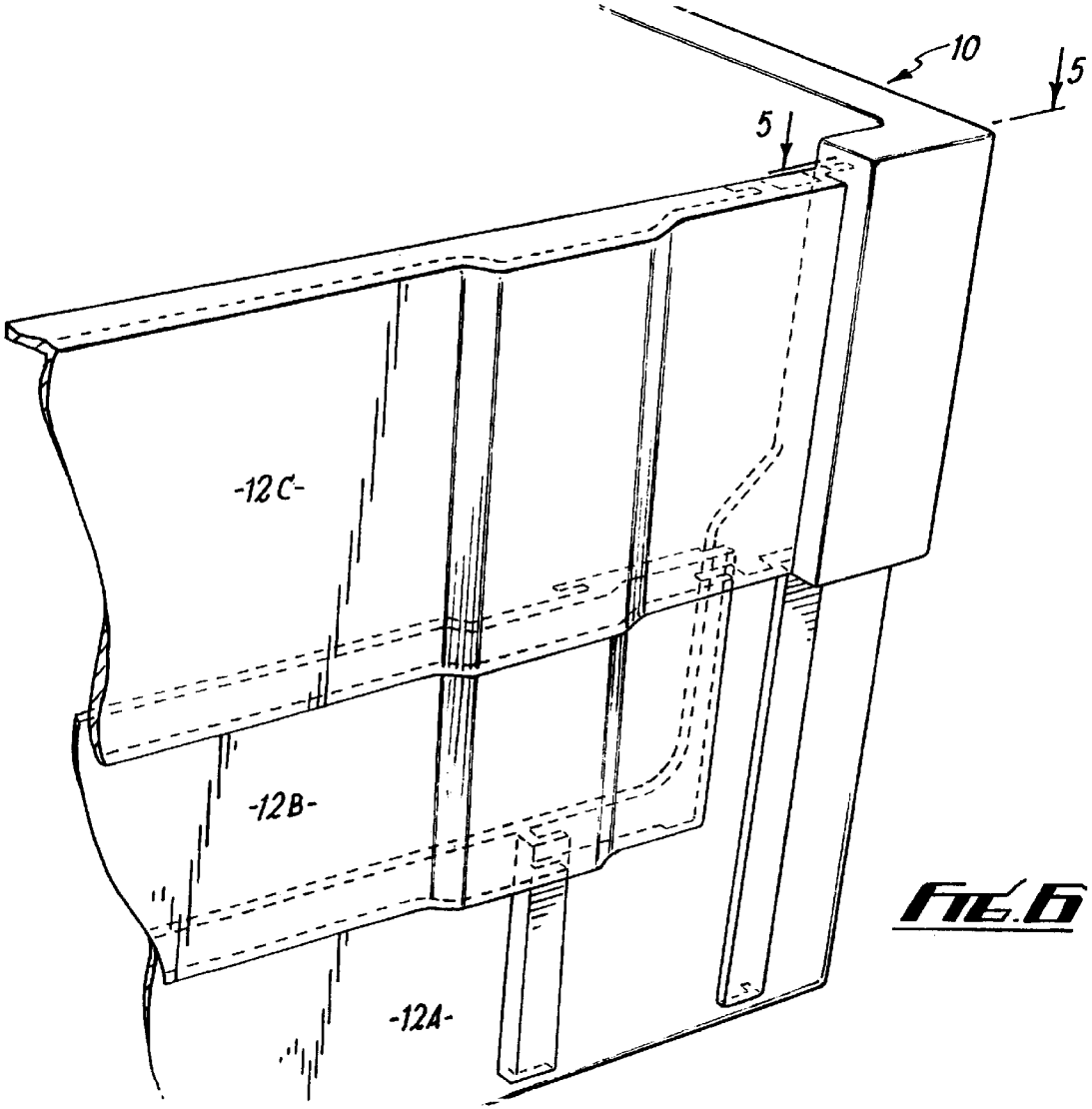
FIG. 6 is an enlarged perspective view of the outside of one wall of the container.

FIGS. 6 and 7 show in more detail one wall of the container 10. This wall comprises a fixed part 12A and two shutter elements 12B, 12C. The wall portion 12A is fixed relative to the rest of the container. The shutters 12B, 12C can slide relative to the rest of the container 10 between an open position in which the contents of the containers are exposed through an opening left in the wall, and a closed position (shown in FIG. 6) in which the opening is closed by the shutter elements 12B, 12C.

The shutter 12C is mounted on the container 10 to slide generally vertically by means of a flange 34 slidable in a channel 35 formed in the container (see FIG. 7). Corresponding formations are provided at the other side of the shutter 12C. A similar sliding connection is provided between the shutter 12C and the shutter 12B, shown generally at 36 in FIG. 7. This allows the shutters 12B, 12C to slide relative to each other. Finally, further similar sliding connections are provided between the shutter 12B and the fixed wall portion 12A, shown generally at 37 in FIG. 7.

Figure 8:
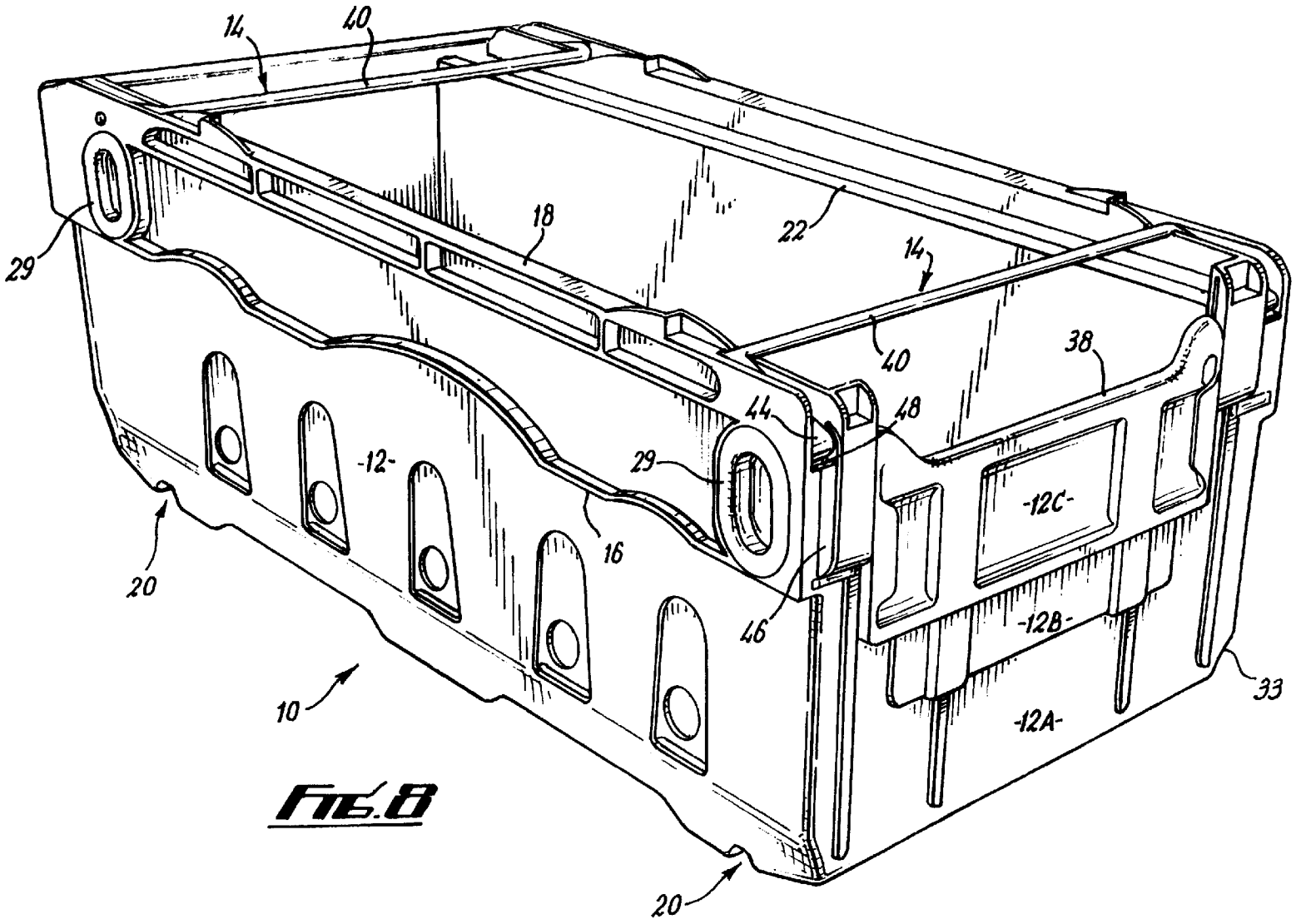
FIGS. 8, 9 and 10 are perspective views of the container in various alternative operating conditions.
Figure 9:
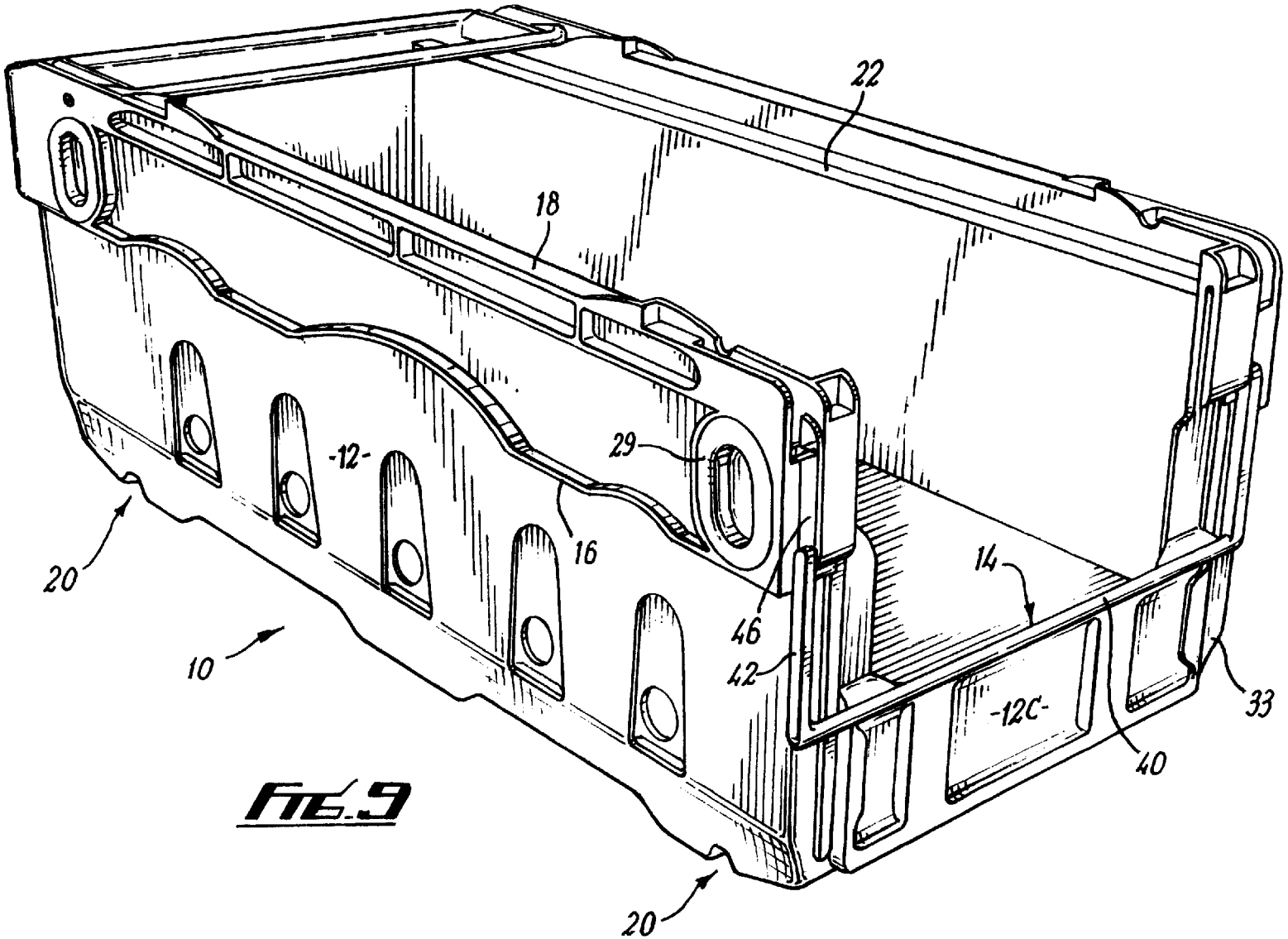

Each of the sliding connections has a detent mechanism associated with it (not shown), such as a small projection and corresponding recess, which acts to lightly hold the sliding component in the uppermost position until overcome by an appropriate downward force. Consequently, pressing on the top edge 38 of the shutter 12C overcomes the detent between the shutter 12C and the rest of the container, allowing the shutter 12C to move down to lie alongside the shutter 12B and expose articles near the top of the container. FIG. 8 shows the shutter 12C having moved part way to this position. Preferably, the vertical heights of the walls and shutters 12A, 12B, 12C are approximately equal, so that this will expose approximately the top one third of the container contents. This might, for instance, be the top layer of stacked contents. A retailer could leave the container open to this extent initially, to encourage customers to take products only from the top layer. However, further downward force on the top edge 38 will allow the shutter 12C to move further down, taking the shutter 12B with it, until both lie alongside the fixed wall 12A, and approximately two thirds of the container contents are then exposed. This condition is shown in FIG. 9.

As has been said, the container 10 is nestable with a like container. Preferably, the shutters 12B, 12C are formed so that when a container is being nested into a lower container, the shutters 12B, 12C of the upper container are engaged and forced to move to their upper, closed position (shown in FIG. 4) as the container is moved to the fully nested position.

Figure 10:
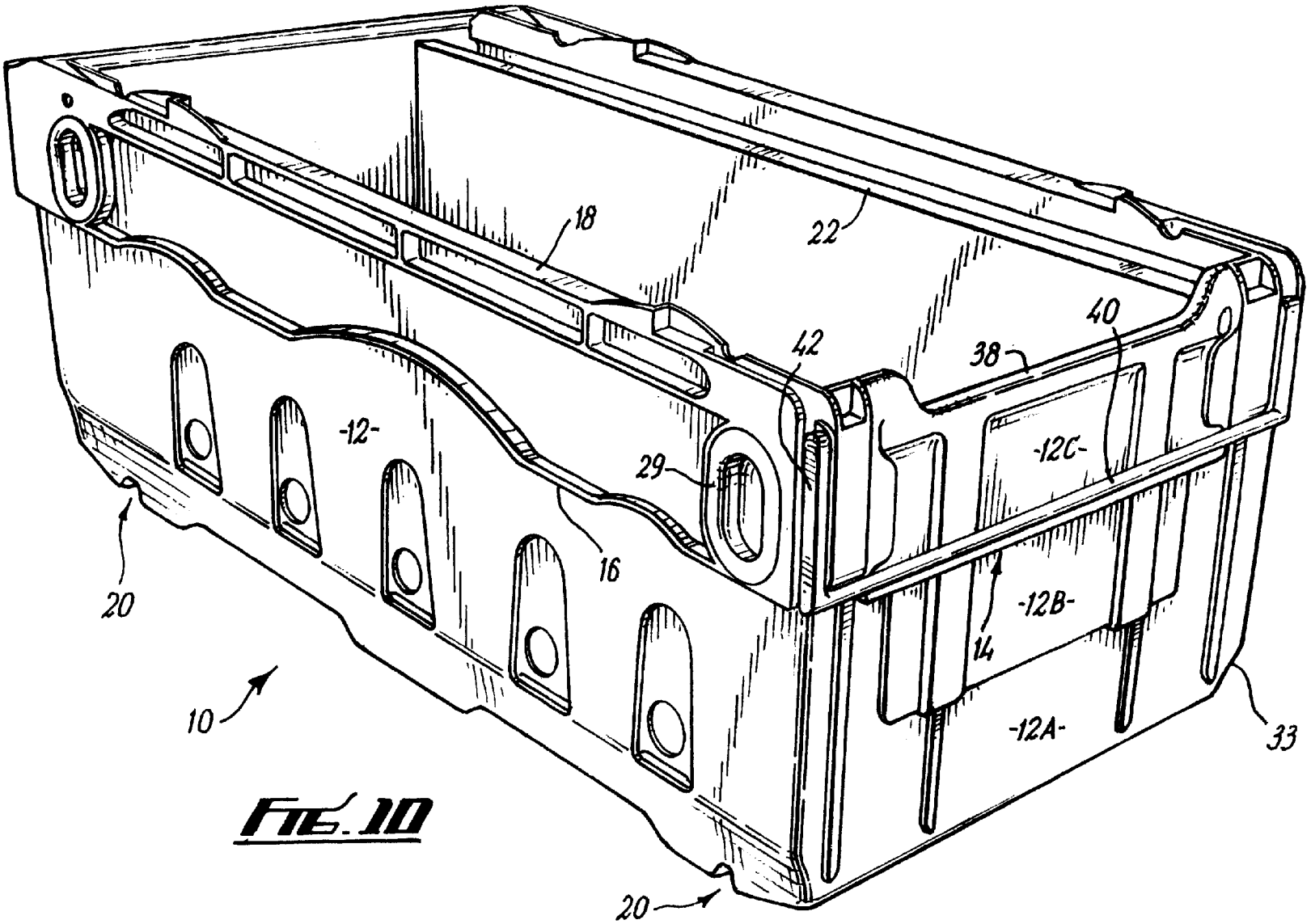

Returning to FIG. 1, it can be seen that the stacking bars 14 are in position for sacking. The main length 40 of the bars 14 extends across the open mouth of the containers, parallel to the shutters 12B, 12C. Shorter pivot arms 42 connect the lengths 40 to pivot lugs 44 which are rotatably located in slots 46 to allow the bars 14 to swing around the lugs 44 until hanging down the outside of the container. In this stowed position (FIG. 10), the mouth of the container is unobstructed, to allow another like container to be nested therein.

However, it will be apparent from the foregoing description that if the bars 14 merely swung around the lugs 44 with the lugs remaining in the position shown in FIG. 1 (at the top of the slots 46), then the lengths 40 would obstruct the opening which can be formed by sliding the shutters 12B, 12C to their lowest positions exposing the upper two thirds of the container contents. To overcome this drawback, the slots 46 extend vertically by an amount equal to approximately one third of the vertical height of the container 10, so that once the bars 14 have swung to the outside of the container, the lugs 44 can then slide down the slots 46 to the lower end. In this position, shown in FIG. 9, the lengths 40 lie approximately at the level of the top edge 38 when the shutters 12B, 12C are at their lowermost positions.

If left in this position, the bars 14 could foul the nesting operation, because the lengths 40 are below the surface 16. This difficulty is overcome by providing a finger 48 on the upper shutter 12C and extending into the slots 46 below the lugs 44. The finger may be an extension, or carried by the flange 30, or the function to be described may be provided by the upper surface of the flange 30. The presence of the flange has two consequences. First, the lugs 44 cannot move dow while the shutters 12C are in the uppermost position. They can simply swing between a nesting and a stacking position. However, once the shutter 12C has slid down, the lugs 44 are then free to slide down the slots 46 once the bars 14 have swung clear of the container mouth. Furthermore, if the container is then nested in another like container below, the shutters 12B, 12C will be pushed up toward their uppermost positions, as has been described. In so doing, the finger 48 will engage the lugs 44, moving them back to the top of the slots 46, thereby moving the lengths 40 to a position just above the level of the surface 16. Nesting is then unimpeded and the bars 14 can be swung back to the stacking position shown in FIG. 1, as desired.

It will be apparent that many variations and modifications can be made to the embodiment described above, without departing from the scope of the invention. In particular, many other arrangements for allowing shutters to open and close could be devised and other interconnections between shutters and stacking bars could be adopted. Sliding shutters could be provided on one wall only, or on more than one wall of the container. Preferably the containers are manufactured wholly or primarily from injection moulded plastics components, but other manufacturing techniques could be used.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A container having walls and defining a space between said walls in which articles may be contained, comprising partition means and attachments means, said attachment means adjustably attaching the partition means to said container within the space, to form a smaller space of variable size, the attachment means comprising complementary formations, said complementary formations being provided on said container and on said partition means, said complementary formations mating to attach said partition means to said container, said complementary formations comprising sufficient resilience in or associated with said complementary formations to allow said partition means to be adjusted along an adjustment direction by application of a sufficient force in said adjustment direction to force said complementary formations to disengage, said complementary formations further comprising a first formation having a plurality of projections or recesses, and a second formation comprising at least one complementary projection or recess, wherein relative movement of said formations to engage said projection or recess of said second formation with another projection or recess of the first formation effects adjustment of said partition means.

2. A container according to claim 1, wherein the first formation comprises a plurality of parallel ribs forming the said projections and defining the said recessed therebetween.

3. A container according to claim 1, wherein the second formation comprises a rib for receipt in a recess of the first formation.

4. A container according to claim 1, wherein the rib extends vertically, in use, to allow adjustment in a horizontal direction.

5. A container according to claim 1, wherein the first formation is fixed relative to the container, ad the second formation is fixed relative to the partition means.

6. A container according to claim 1, wherein the container is open-topped and comprises four walls upstanding from a base to define the space, the partition means being attachable in a generally upright orientation and in the vicinity of one of the walls, to adjust the size of the space.

7. A container according to claim 6, wherein the partition means is accessible through a wall for adjustment from outside the container.

8. A container according to claim 1, wherein the container is a stacking/nesting container, the container and partition means being formed so that, when a container is introduced into a like container for nesting, the container and the partition means of the like container cooperate to move the partition means to a position at which nesting is possible.

* * * * *